United States Patent [19]

Nonnenmann

[11] Patent Number: 4,647,435

[45] Date of Patent: Mar. 3, 1987

[54] CATALYTIC REACTOR ARRANGEMENT INCLUDING CATALYTIC REACTOR MATRIX

[75] Inventor: Manfred Nonnenmann, Schwieberdingen, Fed. Rep. of Germany

[73] Assignee: Suddeutsche Kuhlerfabrik Julius Fr. Behr GmbH & Co. KG, Fed. Rep. of Germany

[21] Appl. No.: 671,866

[22] Filed: Nov. 15, 1984

[30] Foreign Application Priority Data

Nov. 19, 1983 [DE] Fed. Rep. of Germany ..... 3341868

[51] Int. Cl.[4] ..... F01N 3/28

[52] U.S. Cl. ..... 422/180; 422/311; 502/527; 428/186

[58] Field of Search ..... 422/180, 311; 502/527; 428/182, 186; 55/521, DIG. 31

[56] References Cited

U.S. PATENT DOCUMENTS

| | | | |
|---|---|---|---|
| 2,526,657 | 10/1950 | Guyer | 502/527 |
| 3,659,772 | 5/1972 | Dorsey et al. | 428/182 |
| 3,966,646 | 6/1976 | Noakes et al. | 502/527 |
| 4,152,302 | 5/1979 | Nonnenmann et al. | 502/527 |
| 4,186,172 | 1/1980 | Scholz | 422/180 |
| 4,273,681 | 6/1981 | Nonnenmann | 502/527 |
| 4,300,956 | 11/1981 | Rosenberger et al. | 502/527 |
| 4,455,281 | 6/1984 | Ishida et al. | 502/527 |
| 4,464,185 | 8/1984 | Tomita et al. | 422/180 |

FOREIGN PATENT DOCUMENTS

| | | | |
|---|---|---|---|
| 2733640 | 2/1979 | Fed. Rep. of Germany . | |
| 2815317 | 10/1979 | Fed. Rep. of Germany | 502/527 |
| 2902779 | 7/1980 | Fed. Rep. of Germany . | |
| 145537 | 11/1980 | Japan | 502/527 |
| 1491206 | 11/1977 | United Kingdom . | |
| 2094658 | 9/1981 | United Kingdom . | |

*Primary Examiner*—David L. Lacey

*Attorney, Agent, or Firm*—Barnes & Thornburg

[57] ABSTRACT

A matrix for a catalytic reactor used for exhaust gas purification in internal combustion engines includes corrugated strips of sheet steel that are coatable with catalyst material. The sheets are folded to produce several layers in a tubular housing which is traversed by a flow of exhaust gases. The individual layers are part of a continuous length or strip of sheet steel which is folded in a meandering or serpentine fashion. A zigzag folding pattern is especially preferred. This arrangement simplifies manufacturing and results in improved radial equalization of exhaust gases. Uniformity of flow profile is improved by cutouts provided in the matrix material.

13 Claims, 9 Drawing Figures

CATALYTIC REACTOR ARRANGEMENT INCLUDING CATALYTIC REACTOR MATRIX

BACKGROUND AND SUMMARY

This invention relates to a matrix for a catalytic reactor for exhaust gas purification, preferably for use in internal combustion engines and power plants. The matrix is made of corrugated steel sheet in long lengths or strips. The steel is coated with catalyst material. The corrugated steel is arranged in multiple-layers in a tubular housing through which an axial flow of exhaust gas passes parallel to the boundary surfaces of the layers.

German Offenlegungsschrift (OS) No. 2,733,640 shows a matrix wherein the steel strips utilized for matrix construction are made of two layers which include one flat strip and a corrugated strip. This OS also shows a matrix formed of corrugated steel bands that are wound into the desired shape and secured in the axial direction by tang-like punched out portions of one layer pressed into corresponding openings of the adjacent layer. German Unexamined, Published Patent Application No. 2,902,779 shows the use of flat steel strips and corrugated metal sheets in matrix construction to increase the turbulence of the flow passing through the matrix. The strips of corrugated metal sheet are applied to the flat steel strips, or, alternatively, individual flat strips are applied to the corrugated metal sheet. However, all of these arrangements suffer from a common drawback in that the manufacture of a matrix by these techniques is relatively expensive, especially if individual steel strips are used. A disadvantage of conventional types of matrix construction is that a radial equalization of the exhaust gases flowing through the matrix and the reactor is difficult, if not impossible, to attain even if the steel strips of the aforementioned type are provided with cutouts.

Accordingly, an object of the present invention is to provide a matrix for a catalytic reactor which is inexpensive to manufacture and which can be constructed in a variety of external shapes.

Another object of the present invention is to provide a matrix for a catalytic reactor which has an improved radial equalization of the flow profile of the exhaust gases moving through the reactor.

These objects are attained in a matrix formed from a single corrugated sheet which is folded in a meandering, serpentine-like pattern to form a plurality of layers, which matrix is subsequently arranged in a tubular reactor housing and traversed by an axial flow of exhaust gases. By means of this structure, the individual layers of the steel sheet can be formed in a relatively simple fashion, and they remain open on at least one side due to the manufacturing process. Consequently, and in contrast to a wound matrix where flow equalization is possible only in the peripheral direction even when individual strips are employed, the matrix of the present invention provides cutouts in the corrugated and flat strips for radial distribution of the exhaust gases, resulting in a more uniform flow profile and better turbulence of the gas flow and catalytic conversion. Therefore, even the outer layers of the catalyst material are exposed to the gases and contribute to the reaction process. Thus, the matrix can be utilized more advantageously.

A very simple arrangement of the matrix of this invention is obtained by folding the individual layers in a zigzag pattern. If the layers have unequal lengths in the folding direction, oval or round matrix inserts are produced without requiring a complicated structure of several parts. If the layers have equal length in the folding direction, rectangular or rhombic matrix inserts are produced so that the catalytic reactor serving for exhaust gas purification can be adapted in shape to the space available beneath an automobile.

To simplify the manufacturing process, the sheets utilized for forming the matrix are provided with preweakened buckling zones at the folding sites by, for example, perforations in the sheet material. Thus, production of a matrix according to this invention wherein the individual layers are folded over, for example, in a zigzag pattern, can be achieved in the same manner as an endless length of computer paper is folded after exiting from a printer when it is dropped vertically into a chute or other paper receiving apparatus. The perforations provided in the paper cause it to buckle slightly along the folding sites and thereby fold over into the desired shape. Similarly, a matrix can be formed by guiding a continuous perforated sheet or strip into a chute and folding it in the desired pattern. The thus-formed matrix can subsequently be inserted, for example, in a bipartite housing which compresses the matrix structure and adapts it for mounting in the axial flow-path of the gases. It is also possible to axially insert the matrix into a closed, tubular housing through apparatus which resembles a funnel.

The strip of sheet steel utilized for manufacturing the matrix can be formed by three layers wherein the two outer layers are relatively flat and may be provided with cutouts, and wherein the middle layer is a corrugated sheet which likewise may have cutouts or interruptions. However, it is simpler to use a single corrugated sheet, the corrugations of which exhibit a triangular cross section with straight walls lying, respectively, along the outer sides. These walls are separated on one end by gaps which extend transversely across the sheet. The width of these gaps as measured along the length of the sheet, however, is smaller than the width of the opposite, externally located walls (i.e., the third wall of the triangular corrugation). Such a corrugated sheet has the advantage that the individual folded layers do not fold into one another and, thus, folding is possible without the use of flat strips. These corrugated sheets are provided with cutouts so that radial equalization of gas flow is possible in the transverse as well as in the lateral directions. In this connection, the flow cross-section of all cutouts is suitably chosen so that a proportion of 5% up to 30% of the boundary surfaces adjoining each other in the individual layers is obtained. The cutouts should be optimally arranged so that good radial equalization is achieved without the loss of active surface area exerting a negative influence. The cutouts should also be distributed uniformly over the area of the boundary surfaces so that the aforementioned effect of good radial equalization of the exhaust gas flow with a uniform flow profile is attained.

Further objects, features, and advantages of the present invention will become more apparent from the following description when taken with the accompanying drawings which show, for purposes of illustration only, an embodiment constructed in accordance with the present invention.

DETAILED DESCRIPTION OF THE DRAWINGS

Figure 6:
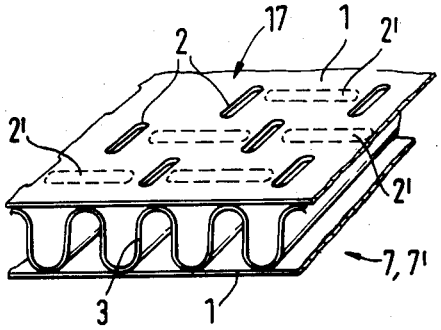
FIG. 6 shows a partial perspective view of the steel strip employed for producing the matrix of FIG. 5.
Figure 7:
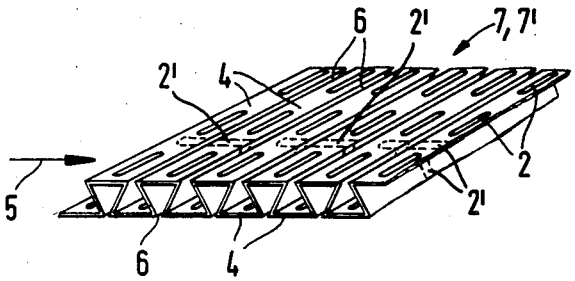
FIG. 7 shows a perspective view of a steel strip provided with triangular corrugations which can be utilized in an especially simple way for the formation of a matrix according to this invention.

FIGS. 1 through 4 show possible folding patterns for forming a matrix for a catalytic reactor according to this invention from continuous sheets or strips of steel. The steel strip utilized in this arrangement can be, for example, strips of the type illustrated in FIGS. 6 or 7. The strip of FIG. 6 is formed of two flat steel sheets 1 and 1′ with openings or cutouts 2 and an interposed corrugated sheet 3. The sheets 1, 1′ and 3 lie loose on each other and are not brazed before folding. The strip of FIG. 7 is formed from a single sheet folded to form corrugations which have triangular cross sections and are arranged so that outwardly oriented surfaces 4 of each corrugation, as measured in the direction of arrow 5, are broader than the gaps 6 disposed between these surfaces. When such a strip is folded to form layers, the corrugations cannot fold into one another. It is, of course, possible to utilize other types of strips, but in each case care must be taken to avoid the use of strips which would "mesh" together when folded into layers.

Figure 1:
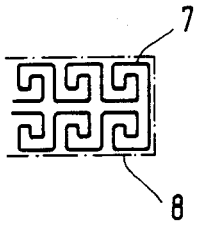
FIG. 1 shows a possible folding pattern for a matrix constructed in accordance with the present invention.
Figure 2:
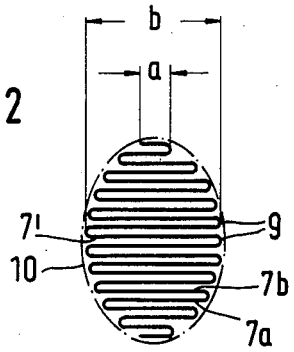
FIG. 2 shows a schematic view of a matrix formed by folding a sheet in a zigzag pattern to conform to the shape of an oval reactor shell.
Figure 3:
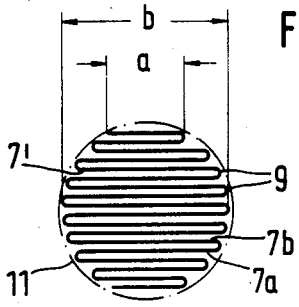
FIG. 3 shows a zigzag folding pattern for forming a matrix to conform to the shape of a round reactor body.
Figure 4:
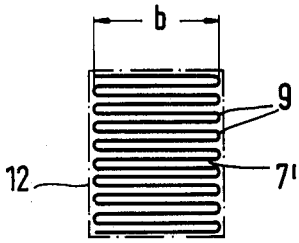
FIG. 4 shows a zigzag folding pattern for forming a matrix to conform to the shape of a rectangular reactor body.

The corrugated sheets or strips as described above are, in accordance with the present invention, folded in a meandering or serpentine fashion to form a matrix. FIG. 1 shows a single continuous strip 7 folded to form a matrix which has a rectangular outer cross section and is insertable into a rectangular housing 8. Simpler zigzag folding patterns are shown in FIGS. 2, 3, and 4. Preweakened buckling zones, can be provided (for example, by means of perforations in the sheets) at the folding sites 9. As a result, the continuous strip 7′, as shown in FIGS. 2, 3, and 4, can be folded in a zigzag pattern to automatically create individual layers *7a, 7b,* etc. By feeding the strip into an appropriate chute so that it folds upon itself in the manner described earlier with reference to the continuous paper sheets. As indicated in FIGS. 2 and 3, it is possible to provide the individual layers *7a* and *7b* with different fold lengths a and b, respectively so that an oval matrix is produced for insertion into oval tubular housing 10 of FIG. 2, or so that a round shape is produced for use with round tubular housing 11 of FIG. 3. It is, of course, also possible to specify that the individual layers have the same fold length b. as in FIG. 4, so that the thus-formed matrix can be inserted in a rectangular housing 12, as shown in FIG. 4.

Figure 5:
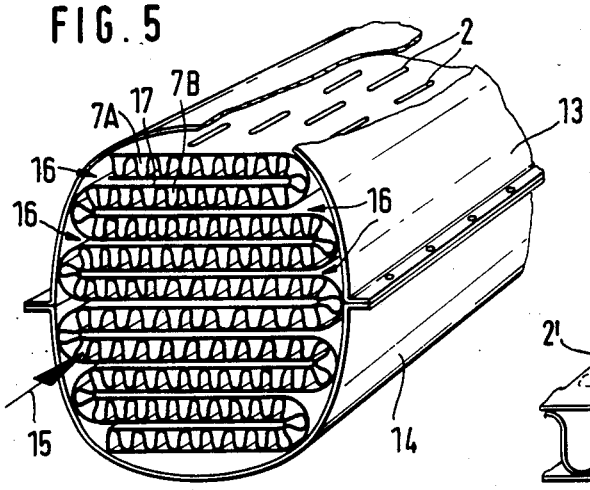
FIG. 5 shows a perspective view of a reactor which includes a matrix produced by folding a steel strip which comprises three layers.

A practical embodiment of the invention is shown in FIG. 5 wherein a strip of sheet steel of the type shown in FIG. 6 is folded in the manner illustrated in FIG. 2 and is clamped between top part 13 and bottom part 14 of a reactor housing and brazed or soldered or welded and is thereby held in the axial direction, i.e. in the throughflow direction indicated by arrow 15. A matrix wherein individual metal sheets 1, 1′, and 3 are conventionally coated with catalyst material has an advantage in that it is very simple to manufacture. Due to the arrangement of cutouts 2, gas equalization is possible in the direction which is transverse to boundary surfaces 17 of individual layers 7A, 7B, etc. The total flow cross section of all cutouts 2 can be chosen so that this radial equalization is obtained resulting in formation of a uniform flow profile. It has been found that this is generally the case if the total flow cross section of cutouts 2 is more than 5% and due to catalytic conversion less than 30% of the area of the boundary surfaces 17. The cutouts can be oriented in the axial (cutouts 2 in FIG. 6) or transverse (cutouts 2′ in FIG. 6) directions. The latter is more advantageous since the cutouts overlap better during layering.

Figure 8:
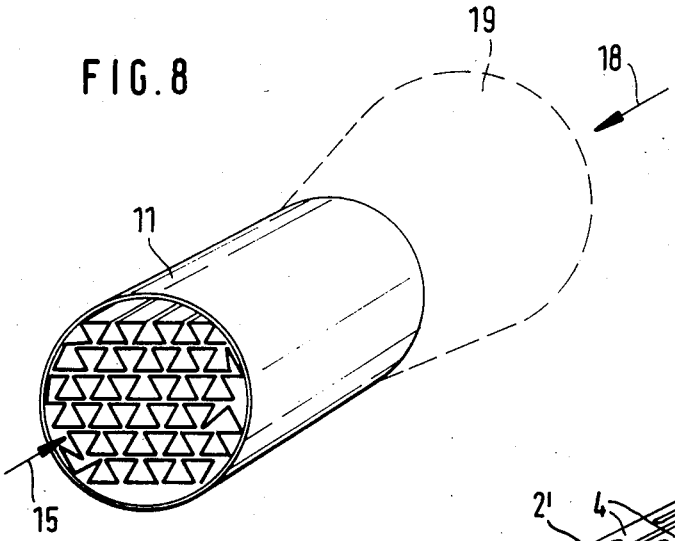
FIG. 8 shows a schematic view of a matrix from the corrugated strip of FIG. 7, positioned in a tubular reactor housing.

FIG. 8 shows another embodiment of matrix for use with a round tubular housing 11. This matrix is formed from a corrugated metal sheet of the type shown in FIG. 7. Housing 11 in this embodiment consists of a single part. The matrix, folded according to the pattern shown in FIG. 3, can be inserted in the tubular housing 11 from the direction of arrow 18 by means of a funnel 19 indicated in dashed lines. The resulting compressive forces can be selected so that an axial seating of the entire matrix is attained. Of course, additional axial mountings may also be provided and, in particular, the matrix can be soldered, brazed or welded in place.

Figure 9:
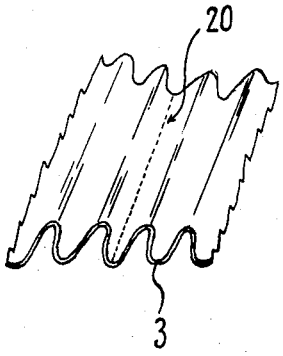
FIG. 9 is a partial schematic view of perforations in the corrugated strip of FIG. 6.

FIG. 9 schematically shows a preferred embodiment of the present invention having a preweakened buckling zone at a folding site. The illustrated preferred embodiment is provided with perforations 20 in the sheet material.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Matrix for a catalytic reactor for purifying exhaust gas, said matrix having a longitudinal axis and comprising a corrugated sheet of steel having surfaces coatable with a catalyst material, and two flat steel sheets, arranged respectively on either side of said corrugated sheet, said flat and corrugated sheets being arranged in a plurality of layers, wherein said layers are formed from said flat and corrugated sheets being folded in a serpentine pattern.

2. Matrix according to claim 1, wherein said serpentine pattern of said layers formed from said flat and corrugated sheets being folded in said serpentine pattern is a zigzag pattern.

3. Matrix according to claim 2, wherein at least a portion of said layers are of unequal lengths as measured in a transverse direction of said matrix.

4. Matrix according to claim 3, wherein said single corrugated sheet is provided with predetermined zones of weakness, each of said zones defining a location of a fold.

5. Matrix according to claim 4, wherein said zones are formed by perforations in said corrugated sheet.

6. Matrix according to claim 1, wherein said single corrugated sheet is provided with predetermined zones of weakness, each of said zones defining a location of a fold.

7. Matrix according to claim 6, wherein said zones are formed by perforations in said corrugation sheet.

8. Matrix according to claim 1, wherein said flat and corrugated steel sheets are provided with cutouts for aiding in equalization of the flow profile of exhaust gases through the matrix.

9. Matrix according to claim 8, wherein the flow cross-sections of said cutouts comprise more than 5% and less than 30% of the surface area of said flat sheets.

10. Matrix according to claim 8, wherein said cutouts are oriented so as to be generally transverse to longitudinal axis of said matrix.

11. Matrix according to claim 8, wherein said cutouts are evenly distributed along said flat sheets.

12. Matrix according to claim 1, wherein said corrugated sheet is provided with cutouts for aiding in equalization of the flow profile of exhaust gases through the matrix.

13. A catalytic reactor arrangement for purifying exhaust gas, said arrangement comprising a tubular housing containing a matrix therein, said matrix comprising a corrugated sheet of steel having surfaces coated with a catalyst material, and two flat steel sheets, arranged respectively on either side of said corrugated sheet, said flat and corrugated sheets being arranged in a plurality of layers in said tubular housing, wherein said layers are formed from said flat and corrugated sheets being folded in a serpentine pattern.

* * * * *